US009010564B2

(12) United States Patent
Jessie et al.

(10) Patent No.: US 9,010,564 B2
(45) Date of Patent: Apr. 21, 2015

(54) REFRIGERATOR CABINET ASSEMBLY

(75) Inventors: Jeffrey Lynn Jessie, Taylorsville, KY (US); David Sheldon, Louisville, KY (US)

(73) Assignee: General Electric Company, Schenectady, NY (US)

( * ) Notice: Subject to any disclaimer, the term of this patent is extended or adjusted under 35 U.S.C. 154(b) by 306 days.

(21) Appl. No.: 13/437,196

(22) Filed: Apr. 2, 2012

(65) Prior Publication Data

US 2013/0256304 A1 Oct. 3, 2013

(51) Int. Cl.

| | |
|---|---|
| ***B65D 88/44*** | (2006.01) |
| ***E06B 7/16*** | (2006.01) |
| ***F25D 23/06*** | (2006.01) |
| ***F25D 23/08*** | (2006.01) |

(52) U.S. Cl.

CPC ..... *F25D 23/066* (2013.01); *F25D 23/082* (2013.01)

(58) Field of Classification Search

CPC ..... F25D 23/06; F25D 23/032; F25D 23/063; F25D 23/066; F25D 23/082; F25D 23/085; F25D 23/087; F25D 2400/04; F25D 2400/06

USPC ..... 220/592.02–592.08; 312/401, 406, 312/406.2, 407, 407.1, 408

See application file for complete search history.

(56) References Cited

U.S. PATENT DOCUMENTS

| | | | | |
|---|---|---|---|---|
| 3,622,215 | A | 11/1971 | Roberts | |
| 3,752,350 | A | 8/1973 | Franck | |
| 4,056,211 | A * | 11/1977 | Zumwalt | 220/592.06 |
| 4,801,181 | A * | 1/1989 | Cordill et al. | 312/407 |
| 4,903,858 | A * | 2/1990 | Clark et al. | 220/592.02 |
| 4,958,890 | A * | 9/1990 | Anderson et al. | 312/406.2 |
| 5,033,182 | A * | 7/1991 | Winterheimer et al. | 29/460 |
| 5,368,381 | A | 11/1994 | Mandel | |
| 5,897,181 | A | 4/1999 | Avendano et al. | |
| 5,899,546 | A * | 5/1999 | Avendano et al. | 312/406.2 |
| 6,036,293 | A | 3/2000 | Anell et al. | |
| 6,655,766 | B2 | 12/2003 | Hodges | |
| 7,108,341 | B2 | 9/2006 | Myers et al. | |
| 7,147,292 | B2 * | 12/2006 | Lee et al. | 312/296 |
| 7,293,847 | B2 * | 11/2007 | Lee et al. | 312/406.2 |
| 7,293,848 | B2 | 11/2007 | Myers et al. | |
| 2009/0058246 | A1 * | 3/2009 | Cittadini et al. | 312/405 |

* cited by examiner

*Primary Examiner* — David Fidei
*Assistant Examiner* — Ernesto Grano
(74) *Attorney, Agent, or Firm* — Global Patent Operation; Douglas D. Zhang

(57) ABSTRACT

A refrigerator appliance comprises an outer case which has an outer case assembly-interface. The refrigerator appliance further comprises an inner liner which has an inner liner assembly-interface. The outer case assembly-interface and the inner liner assembly-interface are configured to enable a locking engagement between the outer case assembly-interface and the inner liner assembly-interface at assembly. The locking engagement may comprise a positive snap-fit engagement.

18 Claims, 4 Drawing Sheets

REFRIGERATOR CABINET ASSEMBLY

BACKGROUND OF THE INVENTION

The subject matter disclosed herein relates to refrigerator appliances, and more particularly to assembly of such refrigerator appliances.

Assembly of an appliance such as a refrigerator typically includes the assembly of a plastic liner inside a metal case. The plastic-lined metal case serves as the storage cavity in which perishable items are placed for cooling during usage. The storage cavity can serve as a fresh food storage area or a freezer storage area, depending on the particular refrigerator design.

It is desirable for the plastic liner and the metal case to be held in proper position with respect to one another. For example, it is desirable to achieve a narrow, uniform gap (front to back and left to right) between the plastic liner and the metal case, when the plastic liner is inserted into the metal case.

Existing refrigerator assembly techniques use one or more foam fixtures to attempt to properly position the plastic liner with respect to the metal case. However, it is known that the foam fixtures do not provide a consistent interface between the plastic liner and the metal case. At a minimum, this inconsistency may negatively impact the perceived assembly quality as well as the thermal performance and the energy efficiency of the appliance.

BRIEF DESCRIPTION OF THE INVENTION

As described herein, the exemplary embodiments of the present invention overcome one or more disadvantages known in the art.

One embodiment of the present invention relates to a refrigerator appliance comprising an outer case which has an outer case assembly-interface. The refrigerator appliance further comprises an inner liner which has an inner liner assembly-interface. The outer case assembly-interface and the inner liner assembly-interface are configured to enable a locking engagement between the outer case assembly-interface and the inner liner assembly-interface at assembly.

Another embodiment of the present invention relates to an outer case of a refrigerator appliance comprising an outer case assembly-interface configured to enable a locking engagement between the outer case assembly-interface and an inner liner assembly-interface of an inner liner of the refrigerator appliance at assembly.

Yet another embodiment of the present invention relates to an inner liner for a refrigerator appliance comprising an inner liner assembly-interface configured to enable a locking engagement between the inner liner assembly-interface and an outer case assembly-interface of an outer case of the refrigerator appliance at assembly.

In one example, the locking engagement is a positive snap-fit engagement.

Advantageously, illustrative embodiments of the present invention provide structure and techniques that provide a consistent interface between the inner liner and the outer case of a refrigerator. At a minimum, this consistency provides for an improved perceived assembly quality of the appliance. Also, the structure and techniques described herein provide a positive indication (via snap-fit) to an appliance assembler that the inner liner and the outer case are assembled properly.

These and other aspects and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and, unless otherwise indicated, they are merely intended to conceptually illustrate the structures and procedures described herein.

DETAILED DESCRIPTION OF THE EXEMPLARY EMBODIMENTS OF THE INVENTION

One or more of the embodiments of the invention will be described below in the context of a refrigerator appliance such as a household refrigerator. However, it is to be understood that embodiments of the invention are not intended to be limited to use in household refrigerators. Rather, embodiments of the invention may be applied to any other suitable refrigeration environments (e.g., commercial, household, or otherwise) in which it would be desirable to improve assembly techniques.

As will be explained in illustrative detail below, embodiments of the invention provide a locking engagement in the form of a positive snap-fit engagement between the inner plastic liner and the outer metal case. More particularly, the plastic liner and the metal case are respectively formed to each have a flange that acts as an assembly-interface. Thus, in the illustrative descriptions below, the term "assembly-interface" may be interchanged with the term "flange." During assembly of the refrigerator, the assembly-interface of the plastic liner (two plane flange, as will be further explained below) and the assembly-interface of the metal case (return flange) are fitted together thereby forming a positive, snap-fit lock there between.

Advantageously, such a locking arrangement eliminates, or at least reduces, the need for foam fixtures for location of the plastic liner with respect to the metal case return flange. The interface between the plastic liner and the metal case flange is an appearance surface to the user. It is therefore realized that a well located, and therefore consistent, interface improves the perceived quality of the appliance. The locking arrangement also provides a positive indication to an appliance assembler that the plastic liner is properly inserted into the metal case. Still further, the locking arrangement improves the thermal performance and the energy efficiency of the appliance.

In one example, as will be depicted and described below in the context of the figures, the plastic liner flange (assembly-interface) has a 'v' or 'u' shaped geometry formed therein. The metal case return flange (assembly-interface) is a c-channel with a 'v' or 'u' shaped bend formed into the metal. The plastic liner flange is inserted into the metal case return flange and uses the 'v' or 'u' shaped geometry to lock the parts together.

Further, as will be seen, the 'v' or 'u' shaped geometry also provides a pocket to hold an anti-condensation heater, e.g., a hot gas loop, which ensures there is appropriate contact between the hot gas loop and the metal case flange.

Figure 1:
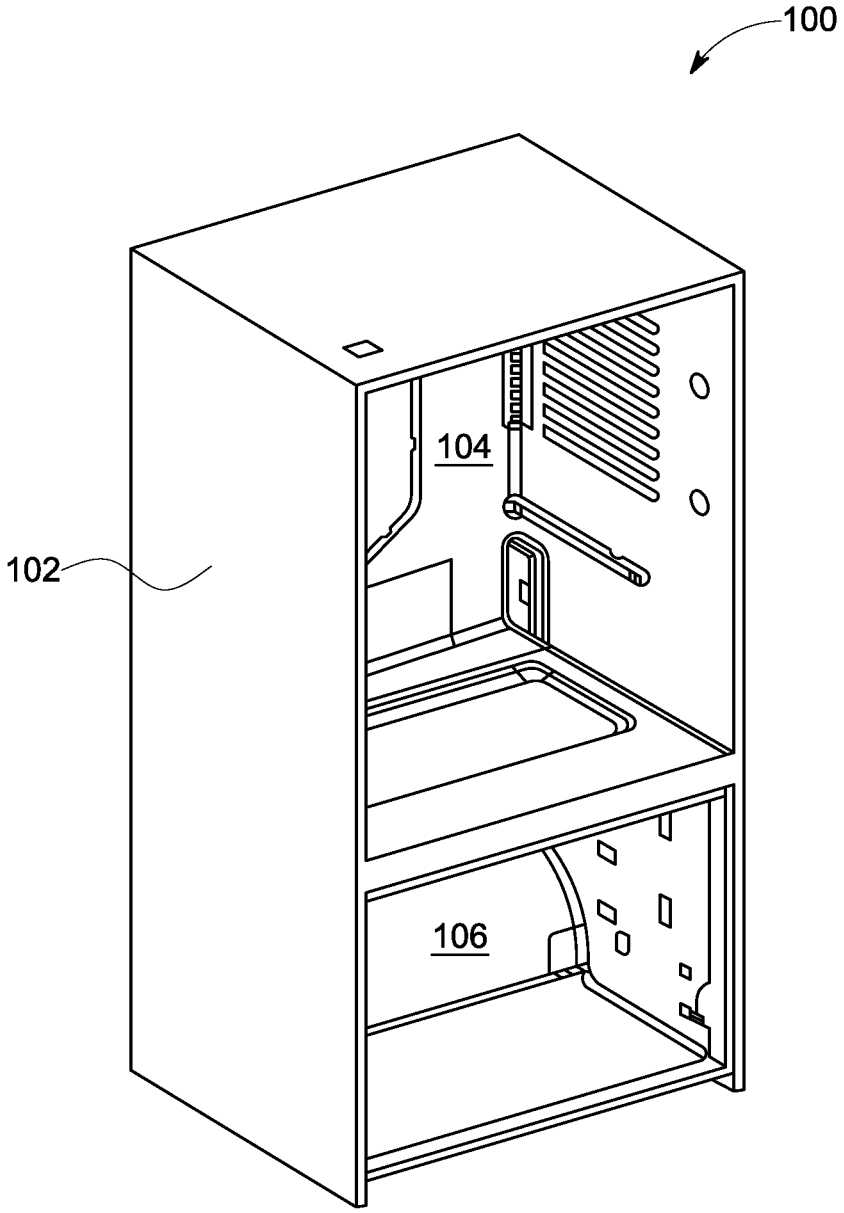
FIG. 1 is a diagram of a perspective view of an outer metal case of a refrigerator appliance, in accordance with an embodiment of the invention.

FIG. 1 is a diagram of a perspective view of an outer metal case of a refrigerator appliance, in accordance with an embodiment of the invention. Note that the outer metal case 102 of the refrigerator 100 depicted in the figure is a metal case associated with a bottom mount freezer configuration, i.e., where the freezer compartment 106 is mounted below the fresh food compartment 104. However, embodiments of the invention may be implemented in other configurations, e.g., a top mount freezer configuration, or a side-by-side configuration.

Figure 2:
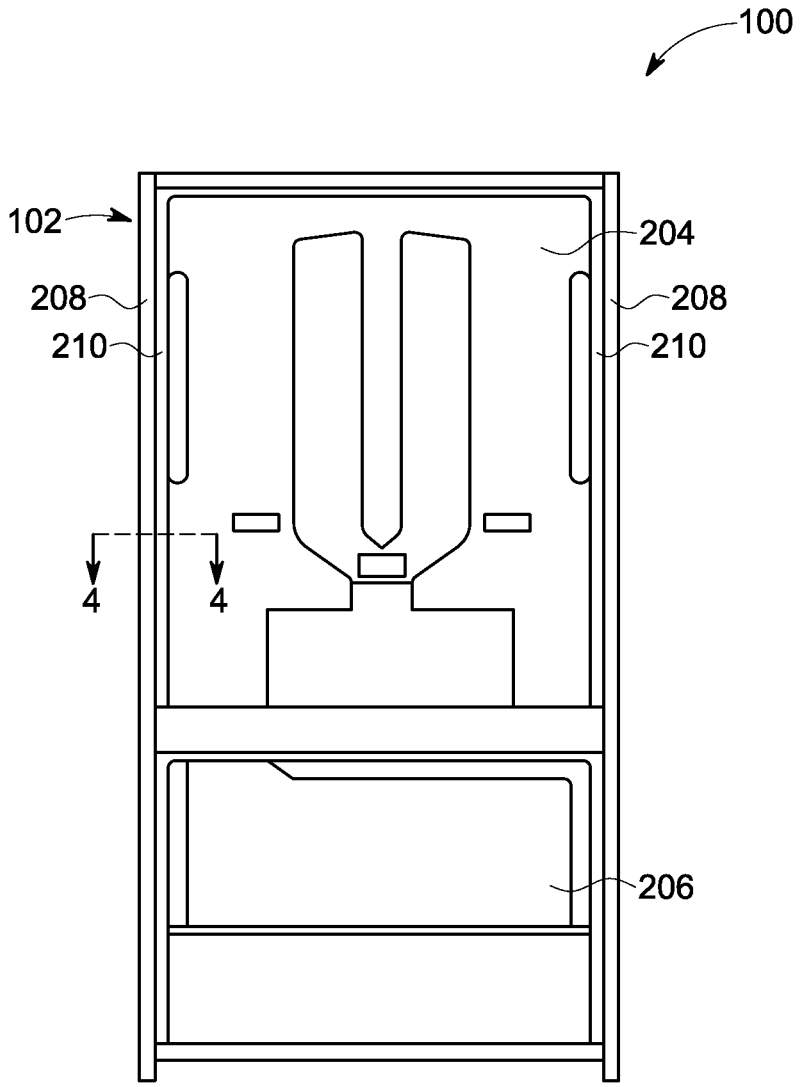
FIG. 2 is a diagram of a front view of a partially-assembled refrigerator appliance, in accordance with an embodiment of the invention.

FIG. 2 is a diagram of a front view of a partially-assembled refrigerator appliance 100, in accordance with an embodiment of the invention. As shown, partially-assembled refrigerator appliance 100 includes the outer metal case 102 (FIG. 1) and an inner plastic liner 204 (fresh food compartment liner) and an inner plastic liner 206 (freezer food compartment liner). The plastic liners 204 and 206 are shown as being inserted into the separate compartments of the metal case 102. While the following description focuses on the plastic liner 204 of the upper (fresh food) compartment of the refrigerator, it is to be understood that the assembly interface techniques and structures described herein are also applied to the plastic liner 206 of the lower (freezer) compartment. Also, it is to be understood that the refrigerator 100 is referred to as "partially-assembled" since there are, of course, other parts (e.g., doors, shelves, refrigeration components, etc.) that are to be installed in the cabinet to form the end appliance product.

Also shown in FIG. 2 are the locations of the metal case assembly-interface (return flange) 208 and the plastic liner assembly-interface (two plane flange) 210. Note that, when assembled (inserted together), the two assembly-interfaces 208 and 210 provide a consistent visible interface for the appliance. Note that while the two assembly-interfaces (flanges) 208 and 210 are shown as extending the vertical length of the fresh food compartment on each side, the assembly-interfaces (flanges) can alternately be formed on the top and bottom of the fresh food compartment, i.e., extending the horizontal width of the fresh food compartment, or can alternately extend around the entire area of the compartment (length and width), or some subset thereof. Also, it is to be appreciated that the flanges can alternately be formed so as not to extend the entire length or width of the fresh food compartment, i.e., running only the partial length or width, or they may even be formed as multiple segments. Remember that the same or similar flange configuration can be implemented in the freezer compartment below.

Figure 3:
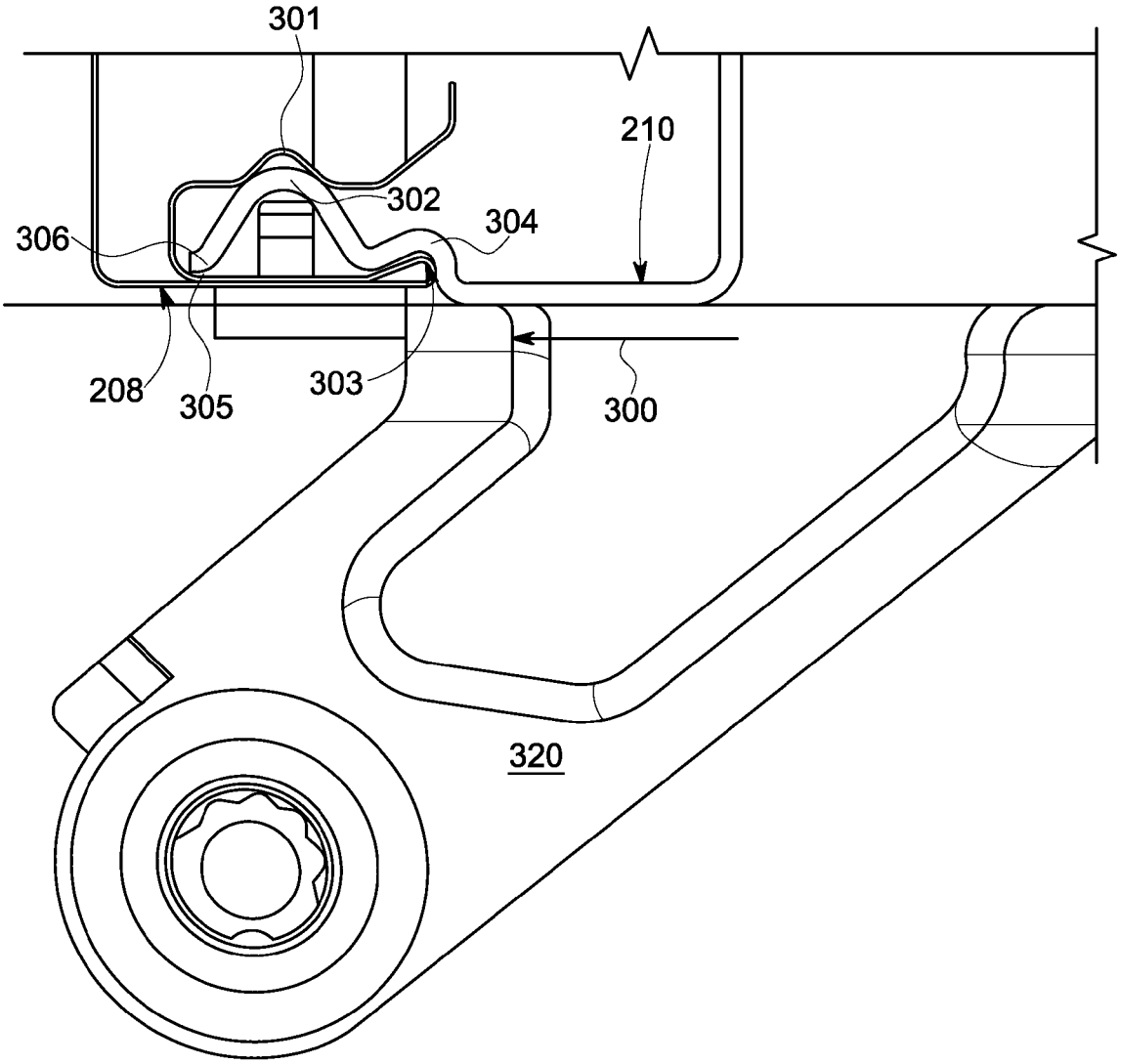
FIG. 3 is a diagram of a cross sectional view of an outer case assembly-interface and an inner liner assembly-interface, in accordance with an embodiment of the invention.

FIG. 3 is a diagram of a cross sectional view of an outer case assembly-interface and an inner liner assembly-interface, in accordance with an embodiment of the invention. As shown, the cross section of the outer metal case assembly-interface (flange) 208 and the plastic liner assembly-interface (flange) 210 in FIG. 3 is taken along line A-A of FIG. 2.

Note that line 300 depicts the assembly operation of the flange 210 being inserted into flange 208. It is to be understood that the metal flange 208 and the plastic flange 210 change shape during insertion, but the metal flange will deflect more than the plastic flange. The metal flange acts like a spring mechanism that provides the clamping load on the joint. FIG. 3 shows the flanges 208 and 210 in the snap-fit, locked (fully engaged) position. The figure also illustrates a lower hinge 320 for the fresh food compartment door (not shown).

As depicted in the figure, the overall all shape of the outer case assembly-interface 208 is a c-shape, thus forming a c-channel down each side of the fresh food compartment. The outer case assembly-interface 208 also comprises a first interface portion 301 that is substantially u-shaped. The inner liner assembly-interface 210 comprises a second interface portion 302 which is also substantially u-shaped. The shapes of the first and second interface portions 301 and 302 are formed (configured) to enable the second interface portion 302 to at least partially fit into the first interface portion 301 at assembly, as shown.

Further, as shown, the outer case assembly-interface 208 further comprises a third interface portion 303 which is loop-shaped. The inner liner assembly-interface 210 further comprises a fourth interface portion 304 which is substantially u-shaped. The shapes of the third and fourth interface portions 303 and 304 are formed (configured) to enable the third interface portion 303 to at least partially engage the fourth interface portion 304 at assembly, as shown.

Still further, the outer case assembly-interface 208 further comprises a fifth interface portion 305 and the inner liner assembly-interface 210 further comprises a sixth interface portion 306. The shapes of the fifth and sixth interface portions 305 and 306 are formed (configured) to enable the fifth and sixth interface portions to at least partially contact one another at assembly, as shown. For example, the two portions are substantially flat where they contact one another.

It can be seen that the second interface portion 302 and the fourth interface portion 304 of the inner liner assembly-interface 210 are configured to be in different planes, while the fourth interface portion 304 and the sixth interface portion 306 of the inner liner assembly-interface 210 are configured to be in substantially the same plane. Although it is not necessary that portions 304 and 306 be precisely in the same plane, it is desirable that they are closer in a planar relationship to one another (i.e., to be in substantially the same plane), as compared with portion 302. Thus, for at least this reason, the inner plastic liner assembly-interface 210 is referred to as a "two plane" flange. The geometries of the two flanges 208 and 210 advantageously enable the plastic liner 204 to lock in a snap-fit manner into the metal case 102. A similar configuration can be implemented for the plastic liner 206 in the lower freezer compartment depicted in FIG. 2.

Figure 4:
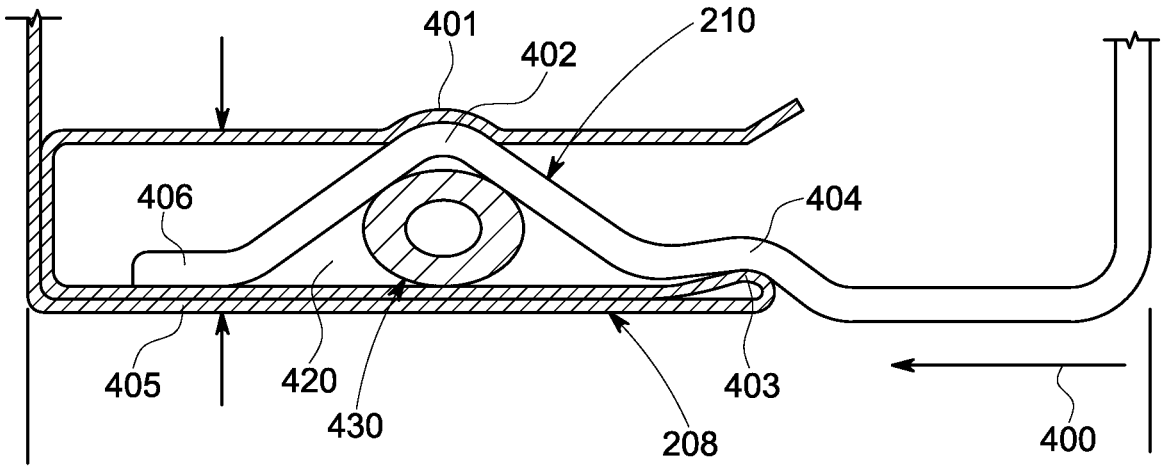
FIG. 4 is a diagram of a cross sectional view of an outer case assembly-interface and an inner liner assembly-interface, in accordance with another embodiment of the invention.

FIG. 4 is a diagram of a cross sectional view of an outer case assembly-interface and an inner liner assembly-interface, in accordance with another embodiment of the invention. Again, as with FIG. 3, the cross section here is taken along line A-A in FIG. 2. The embodiment of FIG. 4 is substantially the same as the embodiment of FIG. 3 (e.g., 401, 402, 403, 404, 405 and 406 are equivalent to 301, 302, 303, 304, 305 and 306, respectively); with the exception that certain of the interface portions of the assembly-interfaces 208 and 210 have alternate shapes.

That is, for example, while second interface portion 402 is equivalent in function to second interface portion 302, the former is substantially v-shaped while the latter is substantially u-shaped. Likewise, first interface portion 401 can be more v-shaped to accommodate the second interface portion 402. Also, as shown, sixth interface portion 406 is longer than sixth interface portion 306, thus providing a larger area of contact with fifth interface portion 405.

The two assembly-interfaces 208 and 210 snap-fit together to form a locking engagement via the same or a similar assembly operation (depicted as line 400) as in FIG. 3 (depicted as line 300).

Further, the embodiment of FIG. 4 comprises a pocket (channel) 420 for holding an anti-condensation heater, in this case, a hot gas loop 430. Advantageously, the geometries of the assembly-interfaces ensure that there is appropriate contact between the hot gas loop 430 and the metal case flange.

Given the teachings herein, it is to be appreciated that assembly-interface geometries other than the ones illustratively depicted in FIGS. 3 and 4 may be realized by those ordinarily skilled in the art, and thus implemented in a straightforward manner.

Furthermore, it is to be appreciated that embodiments of the invention work equally well on roll formed or "precision bent" case sections or on either "single piece wrapper" or "panelized construction" refrigerator cases.

Thus, while there have been shown and described and pointed out fundamental novel features of the invention as applied to exemplary embodiments thereof, it will be understood that various omissions and substitutions and changes in the form and details of the devices illustrated, and in their operation, may be made by those skilled in the art without departing from the spirit of the invention. Moreover, it is expressly intended that all combinations of those elements and/or method steps which perform substantially the same function in substantially the same way to achieve the same results are within the scope of the invention. Furthermore, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A refrigerator appliance comprising:

an outer case having an outer case assembly-interface; and an inner liner having an inner liner assembly-interface;

wherein the outer case assembly-interface and the inner liner assembly-interface are configured to enable a locking engagement between the outer case assembly-interface and the inner liner assembly-interface at assembly, wherein the outer case assembly-interface comprises a first interface portion and the inner liner assembly-interface comprises a second interface portion, the first interface portion and the second interface portion being at least one of substantially u-shaped and substantially v-shaped;

wherein the second interface portion is configured to at least partially fit into the first interface portion at assembly;

wherein the outer case assembly-interface is substantially c-shaped having a first section and a second section spaced apart from and substantially parallel to one another; and wherein the first interface portion protrudes outward from the first section away from the second section.

2. The refrigerator appliance of claim 1, wherein the outer case assembly-interface further comprises a third interface portion and the inner liner assembly-interface further comprises a fourth interface portion, the third and fourth interface portions being configured to enable the third interface portion to at least partially engage the fourth interface portion at assembly.

3. The refrigerator appliance of claim 2, wherein the at least partial engagement of the third and fourth interface portions further comprises the third interface portion at least partially fitting into the fourth interface portion at assembly.

4. The refrigerator appliance of claim 2, wherein the outer case assembly-interface further comprises a fifth interface portion and the inner liner assembly-interface further comprises a sixth interface portion, the fifth and sixth interface portions being configured to enable the fifth and sixth interface portions to at least partially contact one another at assembly.

5. The refrigerator appliance of claim 4, wherein the second interface portion and the fourth interface portion of the inner liner assembly-interface are configured to be in different planes.

6. The refrigerator appliance of claim 5, wherein the fourth interface portion and the sixth interface portion of the inner liner assembly-interface are configured to be in substantially the same plane.

7. The refrigerator appliance of claim 1, wherein the first interface portion and the second interface portion are substantially u-shaped.

8. The refrigerator appliance of claim 1, wherein the first interface portion and the second interface portion are substantially v-shaped.

9. The refrigerator appliance of claim 1, wherein the outer case assembly-interface comprises a return flange.

10. The refrigerator appliance of claim 1, wherein the inner liner assembly-interface is at least partially comprised of a plastic material.

11. The refrigerator appliance of claim 1, wherein the outer case assembly-interface is at least partially comprised of a metal material.

12. The refrigerator appliance of claim 1, wherein the outer case assembly-interface and the inner liner assembly-interface are each configured to enable a hot gas loop to pass there between.

13. The refrigerator appliance of claim 1, wherein the locking engagement comprises a positive snap-fit engagement.

14. The refrigerator appliance of claim 1, wherein assembly comprises insertion of the inner liner into the outer case.

15. An outer case for a refrigerator appliance, comprising:

an outer case assembly-interface configured to enable a locking engagement between the outer case assembly-interface and an inner liner assembly-interface of an inner liner of the refrigerator appliance at assembly, wherein the outer case assembly-interface comprises a first interface portion, the first interface portion being configured such that a second interface portion of the inner liner assembly-interface is configured to at least partially fit into the first interface portion at assembly;

wherein the first interface portion and the second interface portion are at least one of substantially u-shaped and substantially v-shaped;

wherein the outer case assembly-interface is substantially c-shaped having a first section and a second section spaced apart from and substantially parallel to one another; and wherein the first interface portion protrudes outward from the first section away from the second section.

16. The outer case of claim 15, wherein the locking engagement comprises a positive snap-fit engagement.

17. An inner liner for a refrigerator appliance, comprising:

an inner liner assembly-interface configured to enable a locking engagement between the inner liner assembly-interface and an outer case assembly-interface of an outer case of the refrigerator appliance at assembly, wherein the inner liner assembly-interface comprises a second interface portion, the second interface portion being configured to at least partially fit into a first interface portion of the outer case assembly-interface at assembly;

wherein the first interface portion and the second interface portion are at least one of substantially u-shaped and substantially v-shaped;

wherein the outer case assembly-interface is substantially c-shaped having a first section and a second section spaced apart from and substantially parallel to one another; and wherein the first interface portion protrudes outward from the first section away from the second section.

18. The inner liner of claim 17, wherein the locking engagement comprises a positive snap-fit engagement.

* * * * *